US008640723B2

(12) United States Patent
Jacobsen et al.

(10) Patent No.: US 8,640,723 B2
(45) Date of Patent: Feb. 4, 2014

(54) FIRST-STAGE PILOT VALVE

(75) Inventors: Stephen C. Jacobsen, Salt Lake City, UT (US); Shane Olsen, Centerville, UT (US)

(73) Assignee: Raytheon Company, Waltham, MA (US)

( * ) Notice: Subject to any disclaimer, the term of this patent is extended or adjusted under 35 U.S.C. 154(b) by 1044 days.

(21) Appl. No.: 12/072,126

(22) Filed: Feb. 22, 2008

(65) Prior Publication Data

US 2008/0216902 A1 Sep. 11, 2008

Related U.S. Application Data

(60) Provisional application No. 60/903,017, filed on Feb. 22, 2007.

(51) Int. Cl.
*F15B 13/043* (2006.01)

(52) U.S. Cl.
USPC ..... 137/1; 137/596.15; 137/596.16; 137/625.63; 137/625.64; 251/50

(58) Field of Classification Search
USPC ..... 137/596.15, 596.16, 596.17, 625.63, 137/625.64, 625.65, 596.14, 625.27, 137/625.67, 625.69, 1; 251/50
See application file for complete search history.

(56) References Cited

U.S. PATENT DOCUMENTS 2,094,926 A * 10/1937 Nutter et al. ..... 137/625.69
3,151,455 A * 10/1964 Tennis ..... 91/454
3,455,334 A * 7/1969 Martinson ..... 137/625.61
3,910,310 A 10/1975 Hayner
3,913,620 A * 10/1975 Pauliukonis ..... 137/625.64
4,155,535 A * 5/1979 Seamone ..... 251/282
4,220,178 A * 9/1980 Jackson ..... 137/625.3

(Continued)

FOREIGN PATENT DOCUMENTS

GB 2151814 12/1983
JP 5135129 6/1993

(Continued)

*Primary Examiner* — John Fox
*Assistant Examiner* — Kevin Murphy
(74) *Attorney, Agent, or Firm* — Thorpe North & Western LLP

(57) ABSTRACT

A pilot valve configured to provide a control pressure within a dynamic fluid system, the pilot valve comprising: (a) a valve body having a supply port, a return port, and a control pressure port, the pressure control port in fluid communication with a subsequent valving component; (b) an axial bore formed in the valve body and in fluid communication with each of the supply, return, and control pressure ports; (c) a valve spool slidably supported within the axial bore of the valve body, the valve spool configured to control fluid flow through the supply, return, and control pressure ports, and to vary the rate of change of area of at least one of the supply and return pressure ports upon being displaced, thereby providing a variable resistance to fluid flowing therethrough and reducing the quiescent power of the pilot valve; and (d) means for displacing, in a selective manner, the valve spool within the axial bore about the supply, return, and control pressure ports to apportion fluid therethrough to provide a desired control pressure to the subsequent valving component. The pilot valve further comprises a feedback port formed in the valve body and in fluid communication with the control pressure port; and a feedback passage in fluid communication with the feedback port and a portion of the valve spool, the feedback passage configured to receive pressurized fluid therein to act against the valve spool to balance the forces acting on the valve spool from the motor.

17 Claims, 6 Drawing Sheets

(56) References Cited

U.S. PATENT DOCUMENTS

| | | | | | |
|---|---|---|---|---|---|
| 4,569,273 | A | * | 2/1986 | Anderson et al. | 91/447 |
| 4,570,672 | A | * | 2/1986 | Wilke | 137/596.13 |
| 4,615,358 | A | * | 10/1986 | Hammond et al. | 137/625.63 |
| 4,635,682 | A | * | 1/1987 | Walters | 137/625.64 |
| 4,903,727 | A | * | 2/1990 | Motzer | 137/596.16 |
| 5,242,149 | A | * | 9/1993 | Sikkema | 251/129.07 |
| 5,309,943 | A | | 5/1994 | Stevenson et al. | |
| 5,366,202 | A | | 11/1994 | Lunzman | |
| 6,871,668 | B2 | * | 3/2005 | Moreno et al. | 137/625.27 |
| 7,066,206 | B2 | * | 6/2006 | Ino et al. | 137/625.65 |
| 2004/0211469 | A1 | * | 10/2004 | Muller | 137/535 |

FOREIGN PATENT DOCUMENTS

| | | |
|---|---|---|
| JP | 07 332525 | 12/1995 |
| JP | 11280705 | 10/1999 |
| JP | 2001003905 | 1/2001 |
| WO | WO 2006/111031 | 10/2006 |

* cited by examiner

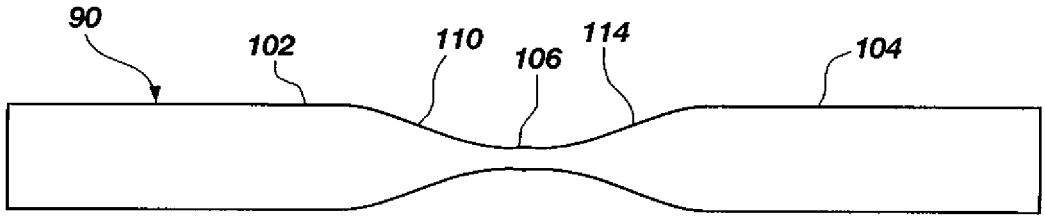
FIG. 6-A
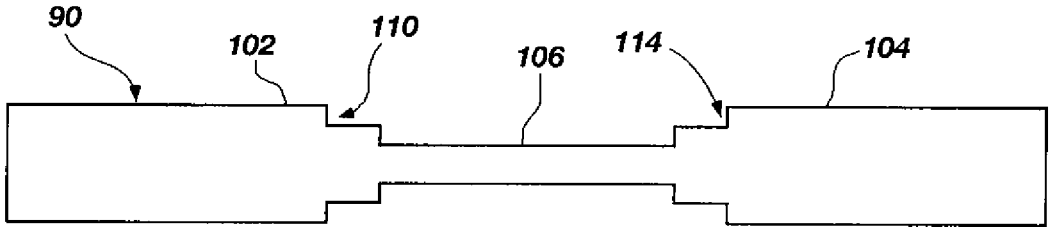
FIG. 6-B
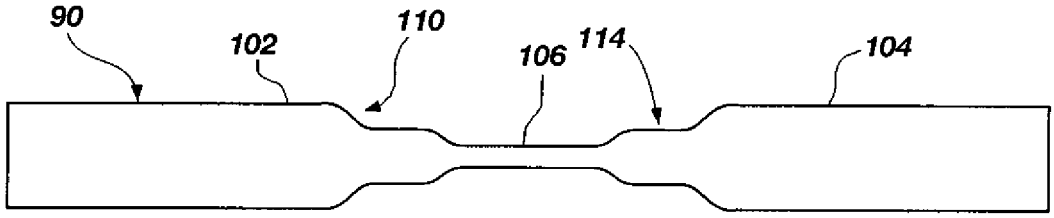
FIG. 6-C
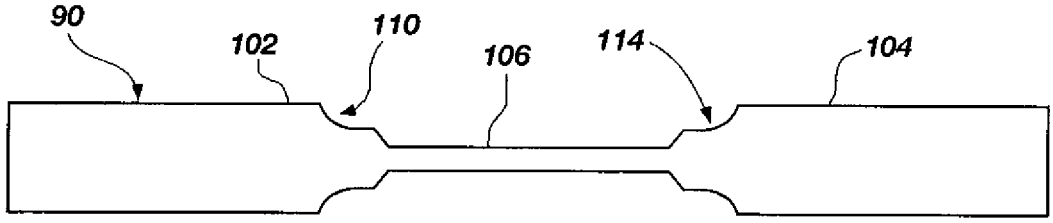
FIG. 6-D

FIRST-STAGE PILOT VALVE

RELATED APPLICATIONS

This application claims the benefit of U.S. Provisional Application Ser. No. 60/903,017, filed Feb. 22, 2007, and entitled, "First Stage Pilot Valve," which is incorporated by reference herein in its entirety.

FIELD OF THE INVENTION

The present invention relates generally to valves and valve structures operable within various dynamic fluid environments. More particularly, the present invention relates to a first-stage, pressure control pilot valve configured to provide a control or pilot pressure to a subsequent valving component, such as a pressure control valve.

BACKGROUND OF THE INVENTION AND RELATED ART

Within various well known fluid dynamic operating systems there exists various staged valving systems, which valving systems often may comprise a first stage or pilot valve configured to provide an output to a subsequent second stage valve or valving system present downstream from the pilot valve. The output from the pilot valve is typically a fluid control pressure that is proportional to the input control signal. This output control may be utilized within the subsequent valve or valving system for one or more purposes, such as to dictate the operational performance of the second stage valve. For example, the control pressure may be utilized to operate a main or interim pressure control valve configured to control flow of fluid under pressure to various actuating components, such as a hydraulic actuator.

Electro-magnetically operated pilot valves for controlling a pressure in proportion to the modulation ratio of a pulse width modulated electrical signal, or in proportion to a voltage level applied to them, are well known. One type of conventional pilot valve comprises a valve spool movably mounted within a valve body for variably coupling the valve inlet port to the valve outlet port. A motor, such as an electrical rotor motor, is mounted on or within the valve body, and is responsive to electrical input control signals that actuate the motor to apply a variable pressure to one end of the valve spool. Valve outlet pressure is fed back to the opposing end of the valve spool. This pressure acts on the effective area of the valve spool, creating a force opposing the motor. Pilot valve outlet control pressure is therefore a function of the input force applied by the motor, which in turn is a function of magnitude of the input control signal applied to the motor.

One problem associated with conventional pilot valves utilizing a valve spool is that these are sensitive to movement of the valve spool, especially if scaled down to be operable within a micro environment. Another problem is that the lands of the valve spool are only capable of providing an abrupt change in area with respect to the distance displaced. In other words, the percentage of the diameter of the orifice or port that is opened determines the amount of flow. This can be expressed as the rate of change in the area of the orifice or port with respect to the rate of change of the displacement of the valve spool, which is the gain of the system. Conventional valves utilize a valve spool with sharp edged lands, which greatly increase the gain of the overall system since the rate of change is abrupt.

Another common type of pilot valve may be referred to as a flapper valve. A conventional flapper valve comprises a magnetic torque motor (utilizing a magnet, a coil, a magnetic plate, and magnetic pole pieces) configured to provide an input control signal to control movement of an armature, which in turn, produces movement in a separate flapper component coupled to the armature. The flapper is positioned between opposing nozzles having equal fluid flow with equal resistance. Pressurized supply fluid continuously flows through both inlet orifices, through the opposing nozzles, and through a drain orifice to the return. In response to the rocking motion of the armature, the flapper is caused to move to throttle fluid flow through one nozzle or the other, thus diverting flow to one of two ends of a valve spool. The spool slides in a sleeve or bore of a valve body that comprises ports that fluidly connect to the supply pressure and return. At null, the spool is centered in the valve body, just covering or closing the pressure and return openings. Movement of the spool to one side or the other allows fluid to flow from the pressure supply to one control port and from the other control port to the return. In doing this, a pressure differential is created that causes the valve spool to displace to open corresponding ports, thus providing a control pressure output.

The flapper valve further comprises a feedback system in the form of a spring coupled to the flapper that engages the spool. The spring is configured such that movement of the spool displaces the spring to create a restoring torque on the flapper, and thus the armature. As the feedback torque becomes equal to the torque from the motor, the armature and flapper are caused to move back to a centered position. Therefore, the position of the spool is proportional to the input signal to the motor. In addition, with constant pressures, flow to load is proportional to spool position.

There are several problems associated with conventional flapper valves, particularly if scaled down to be used in a micro environment. First, they have high quiescent losses. Indeed, when null and with the flapper at rest between the nozzles, the flapper valve has a propensity to leak a tremendous amount of fluid through the nozzles. This is true in a macro or micro environment. If an attempt is made to decrease the amount of leakage by reducing the size of the nozzle orifices, the result is a decrease in fluid flow, and therefore a decrease in bandwidth. Although the amount of leakage may be reduced, the output efficiency is decreased. In other words, larger scale valves may be less efficient, but they provide better output. Conversely, smaller scale valves, while perhaps more efficient, provide less output. In order to get the amount of fluid flow necessary to drive the valve spool at a high frequency, a certain size orifice is needed. However, with such a suitably sized orifice, when the system is at rest, the gap between the nozzles and the flapper is large and the system leaks fluid, thus making the valve inefficient. Second, scaling down conventional flapper valves to a size suitable for operation in a micro environment is both difficult and costly. Micro environments may require operating valves to be on the order of one hundred to several hundred microns. Machining the component parts and orifices to correspond to this size is cost prohibitive. Third, scaling down conventional flapper valves increases their sensitivity to valve spool displacement since the required distance to move the valve spool is significantly reduced. Fourth, scaled down flapper valves may be unstable under desired operating parameters. Indeed, the control pressure from the pilot valve has to be stable in order to properly service the next valve. This is especially true in the case of operating at high frequencies. If a conventional flapper valve is reduced in size too much, it has a greater chance of being perturbed as a result of the flow through orifices that are too small to handle the required capacity. Stated differently, if scaled down to perform in a micro environment, conventional flapper valves will perturb and react unreliably to downstream loads (loads acting against the control or output pressure of the pilot valve) because the corresponding orifices are not large enough to handle the flow of the fluid. Other problems may be recognized by those skilled in the art.

SUMMARY OF THE INVENTION

In light of the problems and deficiencies inherent in the prior art, the present invention seeks to overcome these by providing a pilot valve having a valve spool configured with opposing transition segments configured to vary the rate of change of area of the various supply and return ports within the pilot valve per unit displacement of the valve spool. The present invention pilot valve is particularly suited for small or micro environments to provide the necessary flow or to apportion fluid to drive the subsequent valving component and to reduce leakage, all with low power. However, in small pilot valves using classical spool valve or flapper configurations, to get the necessary flow can cause the valve to become unstable for reasons set forth above. Thus, the transition segments in the valve spool function to soften the on/off transition and allow the gain to be turned down, thus stabilizing the valve. The gain is modulated in order to stabilize the valve.

In accordance with the invention as embodied and broadly described herein, the present invention features a pilot valve configured to provide a control pressure within a dynamic fluid system, the pilot valve comprising: (a) a valve body having a supply port, a return port, and a control pressure port, the pressure control port in fluid communication with a subsequent valving component; (b) an axial bore formed in the valve body and in fluid communication with each of the supply, return, and control pressure ports; (c) a valve spool slidably supported within the axial bore of the valve body, the valve spool configured to control fluid flow through the supply, return, and control pressure ports, and to vary the rate of change of area of at least one of the supply and return pressure ports upon being displaced, thereby providing a variable resistance to fluid flowing therethrough and reducing the quiescent power of the pilot valve; and (d) means for displacing, in a selective manner, the valve spool within the axial bore about the supply, return, and control pressure ports to apportion fluid therethrough to provide a desired control pressure to the subsequent valving component.

The pilot valve further comprises a feedback port formed in the valve body and in fluid communication with the control pressure port; and a feedback passage in fluid communication with the feedback port and a portion of the valve spool, the feedback passage configured to receive pressurized fluid therein to balance the forces acting on the valve spool from the motor.

In one exemplary embodiment, the valve spool comprises an elongate body having, at least in part, a land configured to fit within the axial bore of the valve body; a neck formed along at least a portion of a length of the elongate body, the neck providing a reduced cross-sectional area to facilitate fluid flow through the valve body and at least one of the supply, return, and control pressure ports; and a transition segment extending between the land and the neck, the transition segment configured to vary the rate of change of area of at least one of the supply and return pressure ports upon the displacement of the valve spool thereabout and within the valve spool passage.

In one exemplary embodiment, means for displacing the valve spool comprises a torque motor having a rotor supported about a support structure, the rotor configured to pivot a rocker about a pivot point; and a strut extending from the rocker and configured to engage a first end of the valve spool, the strut functioning to displace the valve spool within the axial bore upon actuation of the torque motor.

The present invention also features a pilot valve comprising: (a) a valve body having a supply port, a return port, and a control pressure port, the pressure control port in fluid communication with a subsequent valving component; (b) an axial bore formed in the valve body and in fluid communication with each of the supply, return, and control pressure ports; (c) a valve spool slidably supported within the axial bore of the valve body and comprising first and second transition segments extending between first and second lands, respectively, and a neck, the valve spool configured to control fluid flow through the supply, return, and control pressure ports, and to vary the rate of change of area of at least one of the supply and return pressure ports upon the first and second transition segments being drawn thereabout, respectively, the transition segments functioning to provide variable resistance to fluid flowing through the supply and return ports and to reduce the quiescent power of the pilot valve; and (d) a motor having a strut configured to selectively displace the valve spool upon actuation of the motor.

The present invention still further features a dynamic fluid system comprising: (a) a pilot valve configured to function as a first stage valve to provide a control pressure, the pilot valve comprising (i) a valve spool slidably supported within an axial bore of a valve body, the valve spool configured to control fluid flow through a supply port, a return port, and a control pressure port, and to vary the rate of change of area of at least one of the supply and return pressure ports upon being displaced, thereby providing a variable resistance to fluid flowing therethrough and reducing the quiescent power of the pilot valve; (ii) a torque motor configured operable with the pilot valve and configured to displace the valve spool within the axial bore about the supply, return, and control pressure ports to apportion fluid therethrough to provide a desired control pressure; (b) a first pressure control valve having an inlet port in fluid communication with the control pressure port to receive the control pressure, the pressure control valve functioning to regulate fluid flow and pressure within the dynamic fluid system; and (c) an actuator in fluid communication with and operable with the first pressure control valve to displace a load.

The present invention still further features a method for providing a control pressure within a dynamic fluid system, the method comprising: (a) providing a pilot valve configured to operate within the dynamic fluid system, wherein the pilot valve comprises elements similar to those described herein; (b) apportioning fluid through the supply and return ports to provide a desired control pressure via the control pressure port; and (c) varying the rate of change of area of the supply and return ports upon displacement of the valve spool to provide a variable resistance to fluid flowing therethrough.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 6-A illustrates an exemplary valve spool having opposing first and second transition segments according to another exemplary embodiment of the present invention;

FIG. 6-B illustrates an exemplary valve spool having opposing first and second transition segments according to another exemplary embodiment of the present invention;

FIG. 6-C illustrates an exemplary valve spool having opposing first and second transition segments according to another exemplary embodiment of the present invention;

FIG. 6-D illustrates an exemplary valve spool having opposing first and second transition segments according to another exemplary embodiment of the present invention.

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 7, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention.

Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

Preliminarily, the phrase "micro environment" or "micro miniature environment," or "micro fluid control system," as used herein, shall be understood to mean an environment where the components operating within such environment are suitably measured in microns. For example, a micro environment may comprise valving components having fluid flow channels, bores, ports and/or lines measuring between 100 and 1,000 microns in diameter.

The present invention describes a method and system for providing a control pressure to a subsequent valving component existing within a fluid control system, and particularly a micro fluid control system. The present invention provides several significant advantages over prior related pilot valves, many of which are recited throughout the following more detailed description. Each of the recited advantages will be apparent in light of the detailed description set forth herein, with reference to the accompanying drawings. These advantages are not meant to be limiting in any way. Indeed, one skilled in the art will appreciate that other advantages may be realized, other than those specifically recited, upon practicing the present invention.

Figure 1:
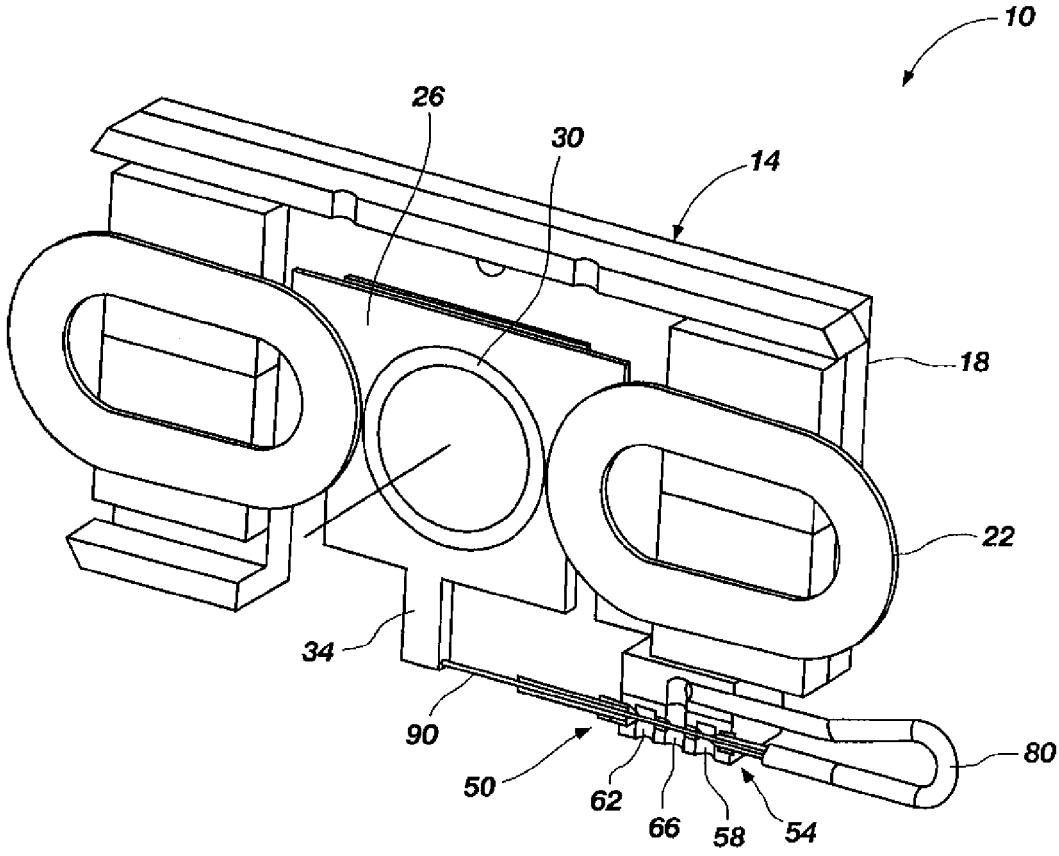
FIG. 1 illustrates illustrated is a perspective view of a first stage pilot valve according to a first exemplary embodiment of the present invention.

With reference to FIG. 1, illustrated is a perspective view of a first stage pilot valve according to a first exemplary embodiment of the present invention. Specifically, FIG. 1 illustrates a pilot valve 10 as comprising means for displacing, in a selective manner, a valve spool 90. The means for displacing may comprise any actuatable system, device, or mechanism capable of causing the valve spool 90 to displace in an intended manner. In the exemplary embodiment shown, means for displacing comprises a motor 14, and more specifically a torque motor, as commonly known in the art. The torque motor 14 comprises a support structure 18 configured to support rotors 22 and a rocker 26, which further comprises a strut 34 extending therefrom and configured to engage an end of the valve spool 90. There is a small amount of sliding that occurs at the mechanical interface of the strut 34 with the end of the valve spool 90 due to rotational movement of the rocker 26 and the strut 34 being used to induce linear movement in the valve spool.

Upon actuation of the motor 14, a motor torque is created and the rotors 22 are caused to rotate, thus causing the rocker 26 to pivot about a pivot point 30. Rotation of the rocker 26 in a given direction causes the strut 34 to also rotate, which in turn, induces a linear directional displacement in the valve spool 90 due to the interaction of the strut 34 with the valve spool 90. The motor 14 can be actuated in a selective manner to cause the rocker 26 to rotate in both a clockwise and a counterclockwise direction about the pivot point 30, depending upon the desired displacement direction of the valve spool 90.

Other means for displacing the valve spool 90 are also contemplated herein. For example, means for displacing may comprise various other motor types or actuators. As such, the description of the torque motor 14 should not be construed as limiting in any way.

The pilot valve 10 further comprises a valve body 50 operably positioned and related to the motor 14 so as to enable the strut 34 of the rocker 26 to engage or otherwise couple the valve spool 90 operably supported within the valve body 50. The valve body 50 comprises an axial bore 54 longitudinally formed within the valve body 50 and configured to receive the valve spool 90, and to facilitate its bi-directional displacement therein. The valve body 50 further comprises a pressurized supply port 58, a pressurized return port 62, a control pressure port 66 that may or may not be pressurized, and a feedback port 70, each configured to be in fluid communication with each other and the axial bore 54, depending upon the position of the valve spool 90.

The pilot valve 10 functions as a pressure control valve to provide a control pressure to a subsequent valving component (not shown, but see FIG. 7) in the fluid control system, such as a subsequent pressure control valve configured to actuate an actuator. As the valve spool 90 is selectively displaced and pressurized fluid is allowed to flow through the valve body 50 from the supply port 58 and exit through the return port 62, the control pressure within the system is varied, which control pressure is supplied to the subsequent valving component via the control pressure port 66 and any fluid lines extending therebetween that function to fluidly couple the pilot valve 10 to the subsequent valving component. At any given time, the control pressure in the system is dictated by the fluid flowing through the valve body 50 and the control pressure port 66.

As indicated, the pilot valve 10 further comprises a valve spool 90. The valve spool 90 is slidably supported within the axial bore 54 of the valve body 50, and is configured to control fluid flow through the supply port 58, the return port 62, the control pressure port 66, and the feedback port 70. More specifically, the valve spool 90 is caused to displace within the axial bore 54 of the valve body 50 about the supply, return, and control pressure ports 58, 62, and 66, respectively, as well as the feedback port 70, in order to apportion fluid therethrough to provide a desired control pressure to the subsequent valving component. The control pressure may be varied by selectively manipulating the position of the valve spool 90 to control the flow of pressurized fluid flowing through the valve body 50 and the respective ports formed therein.

Unlike prior related pilot valves existing in the art, pilot valve 10 of the present invention is configured to function well in micro environments due to its ability to provide a stable control pressure to micro valving components existing within a micro fluid control system. Although the concepts relating to the present invention pilot valve discussed herein may be applicable to macro fluid control systems, they are particularly suited for micro fluid control systems. Indeed, the pilot valve 10 of the present invention is capable of functioning as a micro pilot valve in a micro fluid control system as it has the ability to function with significantly reduced quiescent power. As discussed above, the design and configuration of prior related pilot valves cannot be scaled down to function in a micro fluid system because they will quickly go unstable. On the other hand, the present invention pilot valve is capable of being operated in a micro fluid system because its design facilitates the steady state apportioning of fluid through the various micro ports formed in the valve body, thus allowing the pilot valve to remain stable. In an exemplary micro environment, the axial bore of the valve body may be 200 microns in diameter, with the valve spool being slightly less than this so as to be slidably disposed within the axial bore.

The ability to function in a micro environment or in a micro fluid control system is a result of the unique configuration of the valve spool 90. Unlike prior related valves and valve spools, the present invention comprises a valve spool 90 that is configured to vary the rate of change of area of at least one of the supply and return ports 58 and 62, respectively, upon being displaced, thereby providing a variable resistance to fluid flowing therethrough and reducing the quiescent power of the pilot valve 10. In other words, the configuration of the valve spool 90 functions to tone down the gain. As such, fluid is effectively allowed to flow through ports of small cross-sectional area without causing the pilot valve 10 to go unstable. The pilot valve 10 is more efficient by routing less fluid to gain the needed control and stability is achieved by varying the rate of change of area of the various ports. In addition, the pilot valve 10 significantly cuts down on leakage as compared to prior related valves.

With reference to FIGS. 1-4, the exemplary valve spool 90 comprises a first end 94, a second end 98, a first land 102, a second land 104, and a neck 106. The valve spool 90 further comprises a first transition segment 110 extending between the first land 102 and the neck 106, and a second transition segment 114 that extends between the second land 104 and the neck 106. It is the configuration of the first and second transition segments 110 and 114 that allow the valve spool 90 to vary the rate of change of area of the supply and return ports 58 and 62, and thereby to function within a micro environment to provide a control pressure through the control pressure port 66 to a subsequent valving component. In an exemplary embodiment, the transition segment comprises an overall incline between 10° and 30° as measured from a longitudinal axis of the valve spool 90, but may comprise other inclines.

The present invention solves the problem of simply scaling down prior related pilot valves to function in a micro environment or micro fluid control system, wherein significant leaks and high gain result. Advantageously, the present invention pilot valve 10 provides low leakage and low gain as compared to prior related valves that are simply scaled down versions of their macro counterparts. By simply scaling down prior related pilot valves, bandwidth is lost because the flow volume must be significantly decreased through the valve to avoid perturbing the valve. Although the reduction in fluid may result in a reduction in leakage, output efficiency is also reduced.

The configuration of the valve spool 90 provides a softening of the transition from positive to negative. Stated differently, the configuration of the valve spool 90 provides a subtle transition of the change in output of the control pressure that controls the subsequent valving component at some stable state. This is unlike scaling down h-shaped valve spools, where a sharp edge is used to open or close the ports and the change in output is abrupt. The sensitivity of a pilot valve may be described in terms of the diameter of the ports in relation to the flow of fluid therethrough. As the diameter is decreased to achieve functionality within a micro environment, the distance required to transition from zero flow to full flow gets smaller, until even slight movements in the valve spool are abrupt. To resolve such issues, the present invention pilot valve 10 tones down the gain by changing the profile of the valve spool 90. Instead of a land comprising a sharp edge or face, the valve spool 90 comprises opposing transition segments 110 and 114. In the exemplary embodiment shown in FIGS. 1-4, the valve spool 90 comprises a circular cross-section with the first and second transition segments 110 and 114 having a linear tapered configuration. In short, the present invention pilot valve 10 may be described as a spool valve modified to meet the leakage and gain objectives for a micro operating environment, which are namely low leakage and low gain.

The transition segments 110 and 114 of the valve spool 90 may comprise other configurations, such as other linear configurations, nonlinear configurations, or a combination of these. In addition, the pilot valve 10 may be configured to function in a micro environment or a macro environment, as discussed above. In a micro environment, the valve spool 90 will typically comprise a cross-sectional size suitably measured in microns. For example, the valve spool 90 may comprises a circular circumferential configuration with a diameter between 100 and 1,000 microns.

The pilot valve 10 further comprises a feedback system. In the embodiment shown, the feedback system comprises a feedback passage 80, configured as a fluid feedback passage, in fluid communication with the feedback port 70 formed in the valve body 50. The feedback passage 80 comprises a first end 82 in fluid communication with the feedback port 70 formed in the valve body 50, and a second end 84 in fluid communication with the axial bore 54 and the second end 98 of the valve spool 90. The feedback passage 80 is configured to receive pressurized fluid therein to act against the valve spool 90 and to urge it in a direction against the strut 34 of the motor 14 to close the supply port 58. More specifically, as the pressure within the valve body 50 increases, the feedback passage 80 receives the pressurized fluid and functions to act against the valve spool 90 to displace it in a direction opposite that as urged by the strut 34 of the motor 14, or in other words to urge the rocker 26 to rotate about the pivot point 30 in an opposite direction, or rather to balance the forces being applied by the motor on the valve spool 90. As such, the feedback passage 80 functions to oppose the forces acting on the valve spool 90 as induced by the motor 14. The feedback system functions to create a restoring torque on the strut 34, as well as the rocker 26 and the rotors 22 of the motor 14. As the feedback torque becomes equal to the input torque from the motor 14, the rocker 26 and the strut 34 are urged back to a resting position. As such, the position of the valve spool 90 within the valve body 50 is caused to be proportional to the input signal to the motor 14.

Figure 2:
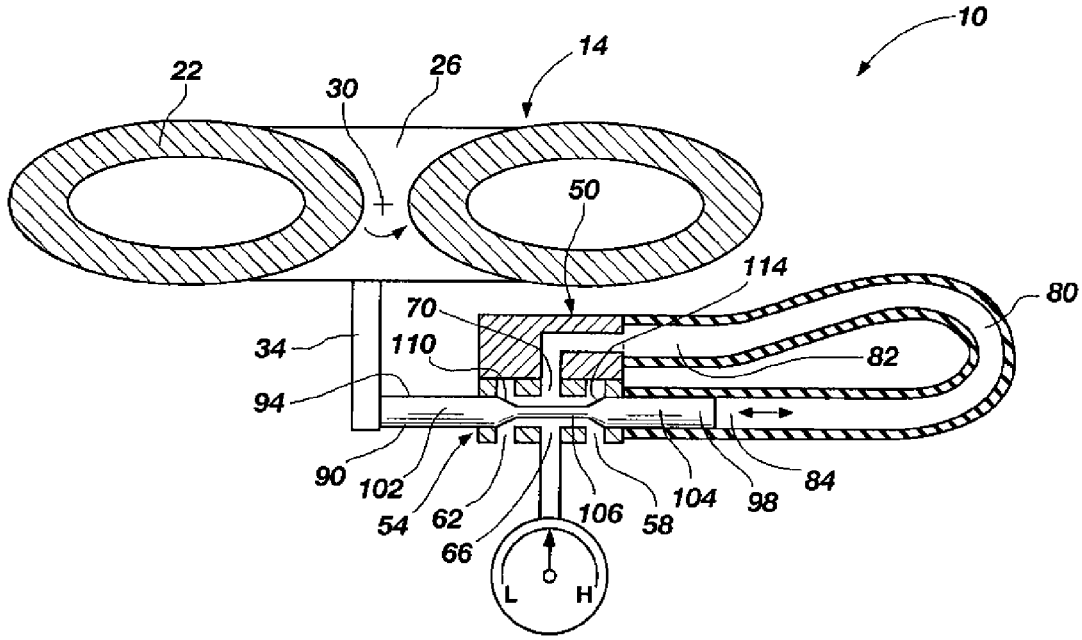
FIG. 2 illustrates is a representation of the present invention pilot valve of FIG. 1, according to one exemplary embodiment, with the motor providing a motor torque so as to place the pilot valve in a state of equilibrium.

With specific reference to FIG. 2, illustrated is a representation of the present invention pilot valve of FIG. 1, according to one exemplary embodiment, with the motor 14 providing a motor torque so as to place the pilot valve 10 in a state of equilibrium. In this state, the pilot valve 10 is equalized in that the supply port 58 and the return port 62 are both open substantially the same to allow comparable fluid flow therethrough. With the valve spool 90 in this position, the control pressure provided by the pilot valve 10 via the control pressure port 66 is approximately half of the pressure of the fluid flowing in through the supply port 58 or the supply pressure. This is indicated by the gauge in fluid communication with the control pressure port 66, which reads midway between low and high pressure.

With the valve spool 90 positioned an equidistance, relatively speaking, so that the supply port 58 and the return port 62 are both partially open, pressurized fluid is allowed to flow through these ports, as well as the control pressure port 66. The influx of pressurized fluid is partially offset by the outflow of a portion of the pressurized fluid through the return port 62. As fluid is apportioned through the valve body 50 in this manner, the control pressure supplied by the pilot valve 10 to the subsequent valving component is not as high as it would be if the return port 62 were totally closed, nor is it as low as it would be if the return port 62 were totally open.

The pressurized fluid in the pilot valve 10 further flows through the valve body 50, through the feedback port 70, and into the feedback passage 80 where it is caused to contact the second end 98 of the valve spool 90. In this case, the motor 14 applying a motor torque to the first end 94 of the valve spool 90 and the feedback force applied by the feedback passage 80 to the second end 98 of the valve spool 90 are equalized to position the valve spool 90 in the position shown.

Figure 3:
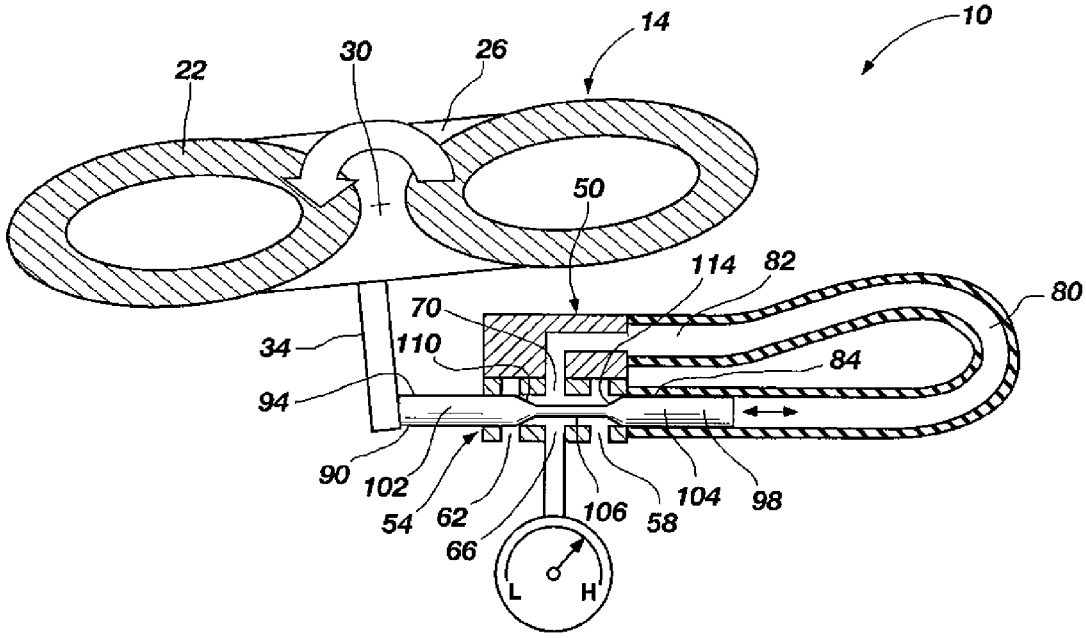
FIG. 3 illustrates a representation of the present invention pilot valve of FIG. 1, according to one exemplary embodiment, with the motor torque from the motor increased by an increase in input signal to cause the rotor and the rocker to pivot in a counterclockwise direction about pivot point to open the supply port and increase the control pressure.

With specific reference to FIG. 3, illustrated is a representation of the present invention pilot valve of FIG. 1, according to one exemplary embodiment, with the motor torque from the motor 14 increased by an increase in input signal to cause the rotor 22 and the rocker 26 to pivot in a counterclockwise direction about pivot point 30. As the rotors 22 and rocker 26 are caused to rotate, the strut 34 extending down from the rocker 26 and engaged with the first end 94 of the valve spool 90 is also caused to rotate. Stated differently, FIG. 3 illustrates actuation of the motor 14 to cause the valve spool 90 to displace in a direction to open the supply port 58 and to close the return port. Indeed, rotation of the strut 34 effectively induces a linear displacement of the valve spool 90 within the axial bore 54 formed in the valve body 50, which linear displacement opens the supply port 58, while closing the return port 62.

Increasing the input signal in the motor 14 to increase the motor torque, and to thereby open more fully the supply port 58, results in a corresponding increase in the control pressure supplied by the pilot valve 10 through the control pressure port 66. This is depicted by the gauge in fluid communication with the control pressure port 66, which reads within a high pressure range. As the motor torque is increased, the rotor 22 pivots about pivot point 30, which causes the rocker 26 and the strut 34 to also rotate. This causes the valve spool 90 to displace within the axial bore 54 of the valve body 50 as described, thus increasing the opening of the supply port 58 and decreasing the opening of the return port 62. The control pressure increases more and more as the supply port 58 is opened and the return port 62 is closed, until the control pressure reaches a maximum pressure, wherein the supply port 58 is fully opened and the return port 62 is fully closed.

Moreover, as the control pressure increases, the feedback pressure in the feedback passage 80 also increases so as to impose a negative feedback force on the second end 98 of the valve spool 90. Any difference or error between the motor force and the feedback force acting on the valve spool 90 will tend to move the valve spool 90 until the two forces are balanced or equal. In other words, the feedback pressure functions to urge the valve spool 90 to close the supply port 58. As such, and as indicted above, the control pressure is therefore proportional to the motor torque.

Figure 4:
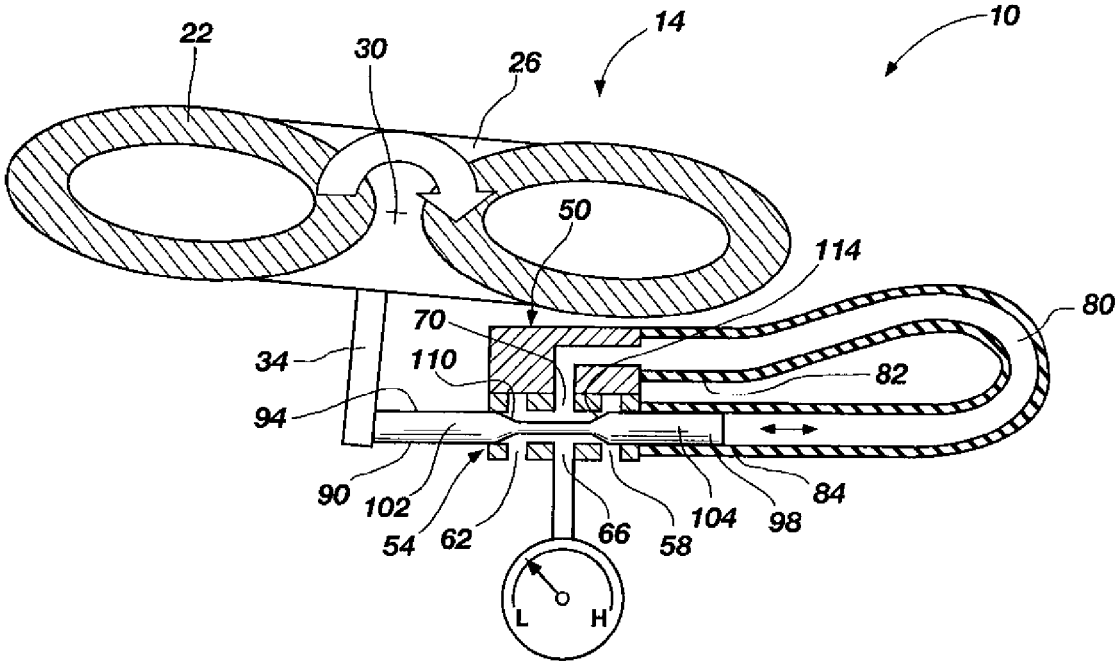
FIG. 4 illustrates a representation of the present invention pilot valve of FIG. 1, according to one exemplary embodiment, with the motor torque from the motor decreased by a decrease in input signal to cause the rotor and the rocker to pivot in a counter-clockwise direction about pivot point to open the return port and decrease the control pressure.

With specific reference to FIG. 4, illustrated is a representation of the present invention pilot valve of FIG. 1, according to one exemplary embodiment, with the motor torque from the motor 14 decreased by a decrease in input signal to cause the rotor 22 and the rocker 26 to pivot in a counter-clockwise direction about pivot point 30. As the rotors 22 and rocker 26 are caused to rotate, the strut 34 extending down from the rocker 26 and coupled to the first end 94 of the valve spool 90 is also caused to rotate. Stated differently, FIG. 4 illustrates actuation of the motor 14 to cause the valve spool 90 to displace in a direction to close the supply port 58 and to open the return port 62. Indeed, rotation of the strut 34 effectively induces a linear displacement of the valve spool 90 within the axial bore 54 formed in the valve body 50, which linear displacement closes the supply port 58, while opening the return port 62.

Decreasing the input signal in the motor 14 to decrease the counter-clockwise motor torque results in a corresponding decrease in the control pressure supplied by the pilot valve 10 through the control pressure port 66. This is depicted by the gauge in fluid communication with the control pressure port 66, which reads within a low pressure range. As the motor torque is decreased, the rotor 22 pivots clockwise about pivot point 30, which causes the rocker 26 and the strut 34 to also rotate clockwise. This causes the valve spool 90 to displace within the axial bore 54 of the valve body 50, as described, thus decreasing the opening of the supply port 58 and increasing the opening of the return port 62. The control pressure decreases more and more as the supply port 58 is closed and the return port 62 is opened, until the control pressure reaches a minimum or zero pressure, wherein the supply port 58 is fully closed and the return port 62 is fully opened.

As the control pressure decreases, the feedback pressure in the feedback passage 80 also decreases so as to impose less of a negative feedback force on the second end 98 of the valve spool 90. Again, any difference or error between the motor force and the feedback force acting on the valve spool 90 will tend to move the valve spool 90 until the two forces are balanced or equal. The more the motor torque is decreased, the less active is the feedback pressure acting on the valve spool 90. In addition, as is the case for all positions of the valve spool 90, the control pressure is proportional to the motor torque.

Figure 5:
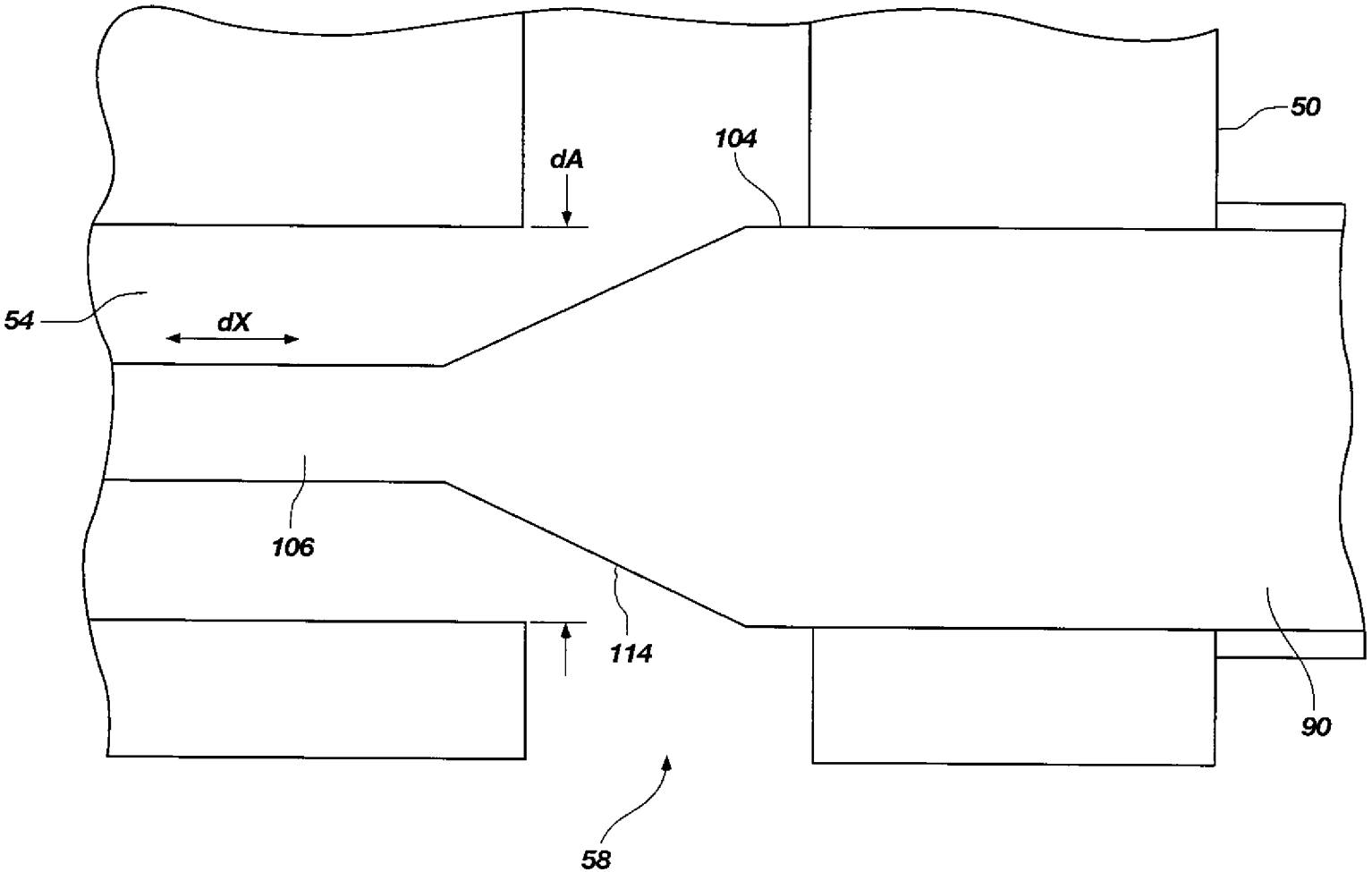
FIG. 5 illustrates a detailed view of an exemplary transition segment of the exemplary valve spool and its relationship to the supply pressure port upon displacement thereabout.

With reference to FIG. 5, illustrated is a detailed view of a portion of the valve spool 90 and its relationship to the supply pressure port 58 upon displacement. As can be seen, the valve spool 90 comprises with a transition segment 14 configured to vary the rate of change of the area or opening of the supply port 58 per unit displacement of the valve spool 90 within the axial bore 54 of the valve body 50 in a direction to do so. The transition segment 114, shown as having a linear tapered configuration and comprising a circular cross-section, extends between the land 104 and the neck 106 of the valve spool 90. In a position to close the supply port 58, the valve spool 90 is located about the opening of the supply port 58 so that the land 104 is covering the opening, with no part of the transition segment 114 or neck 106 about the opening. As the motor torque is selectively increased and the valve spool 90 selectively displaced, the transition segment 114 displaces about the opening of the supply port 58 a distance in accordance with the input to the motor. The motor torque may be further increased to fully displace the valve spool 90 and open the supply port 58. As such, the displacement of the valve spool 90 relative to the supply and return openings is selective and variable.

Upon displacement of the valve spool 90 and as the transition segment 114 displaces about the opening of the supply port 58, the area of the supply port, and more particularly the area of the supply port 58 changes. This change in area, or $\Delta A$ is represented by the reference dA in FIG. 5. The change in unit displacement of the valve spool 90 is represented by the reference dX. Thus, the rate of change of area of the supply port 58 per unit displacement of the valve spool 90 may be expressed as dA/dX, or gain of the system, which determines the amount of flow of pressurized fluid through the supply port 58.

By providing a transition segment 114 on the valve spool 90, the present invention pilot valve 10 functions to change the rate of change of the area of the supply port 58, or in other words, to change the rate dA/dX, or the gain of the system. As the transition segment 114 displaces about the opening of the supply port 58, the rate of change of area changes due to the tapering configuration of the transition segment 114. This change to the rate of the change in area effectively functions to resist the flow of pressurized fluid through the supply port 58. As such, the transition segment 114 may be thought of in terms of a variable resistor. The transition segment (not shown) located opposite the transition segment 114 provides a similar function with respect to the return port (not shown). In essence, the valve spool 90 provides variable resistance to the fluid through its variable displacement positions and resulting variable changes in opening size for the respective ports. The change in resistance to the fluid further functions to change or vary the control pressure leading out of the control pressure port 66.

Advantageously, the valve spool is not like nor does it function like sharp edge servo valves, but more like a variable resistor due to its design. The edges are softer, whereas prior related spool valves provide abrupt edges extending from the lands. The softening of the edges is particularly useful in micro environments where stability is a major concern. With prior related pilot valves using h-type valve spools, particularly such pilot valves scaled down, these would be unstable due to the fact that even small movements of the valve spool would excite big actions. By providing transition segments in the valve spool, the pilot valve of the present invention has a lot less quiescent power relative to prior related pilot valves because the transition from positive to negative is softened and less fluid is used.

Another problem with prior related pilot valves, even those of the flapper type, is the difficulty of providing large enough orifices or ports to enable sufficient fluid flow, while at the same time providing a workable micro pilot valve. Indeed, small orifices or ports (those on the order of microns) are difficult to form in a valve body and difficult to make operable with a flapper or valve spool. Obviously, the smaller the size of the port or orifice in the valve, the less capacity it has to service the subsequent valving component. Moreover, to properly service the subsequent valving component, the pilot valve must operate with stability. In other words, the output not only is and has to be a control pressure for the next valve, but it also has to be stable. When the subsequent valving component the pilot valve is servicing or controlling operates at high frequencies, the pilot valve, if reduced in size too much and not configured properly, can be perturbed due to the flow through the too small orifices. Unlike prior related pilot valves that are a scaled down version of a macro counterpart, and that perturb and react unreliably to downstream loads (loads acting against the control or output pressure of the pilot valve) because their too small orifices are unable to handle the flow of the fluid, the present invention pilot valve provides the ability to tone down the gain, reduce quiescent power, stabilize fluid flow, and cut down on leakage, all advantages in a micro operating environment. These advantages are realized in light of the transition segments provided in the valve spool 90.

It is noted herein, and it will be apparent to one skilled in the art, that the transition segment formed in the valve spool opposite the one shown and described herein is sized and configured in a similar manner, and operates or functions in a similar manner to vary the rate of change of area of the supply port 62. The particulars for this transition segment are therefore not discussed in detail herein.

With reference to FIGS. 6-A-6-D, illustrated are several side views of variously configured valve spools according to other exemplary embodiments of the present invention. Specifically, FIG. 6-A illustrates the valve spool 90 as comprising first and second lands 102 and 104, a neck 106, and first and second transition segments 110 and 114 extending between the first and second lands 102 and 104, respectively, and the neck 106. In this particular embodiment, the transition segments 110 and 114 comprise a nonlinear or curved configuration.

FIG. 6-B illustrates the valve spool 90 as comprising first and second lands 102 and 104, a neck 106, and first and second transition segments 110 and 114 extending between the first and second lands 102 and 104, respectively, and the neck 106. In this particular embodiment, the transition segments 110 and 114 comprise a series of linear steps or ledges.

FIG. 6-C illustrates the valve spool 90 as comprising first and second lands 102 and 104, a neck 106, and first and second transition segments 110 and 114 extending between the first and second lands 102 and 104, respectively, and the neck 106. In this particular embodiment, the transition segments 110 and 114 comprise a series of nonlinear concave and convex curved portions formed together.

FIG. 6-D illustrates the valve spool 90 as comprising first and second lands 102 and 104, a neck 106, and first and second transition segments 110 and 114 extending between the first and second lands 102 and 104, respectively, and the neck 106. In this particular embodiment, the transition segments 110 and 114 comprise a combination of linear and nonlinear portions formed together.

Figure 7:
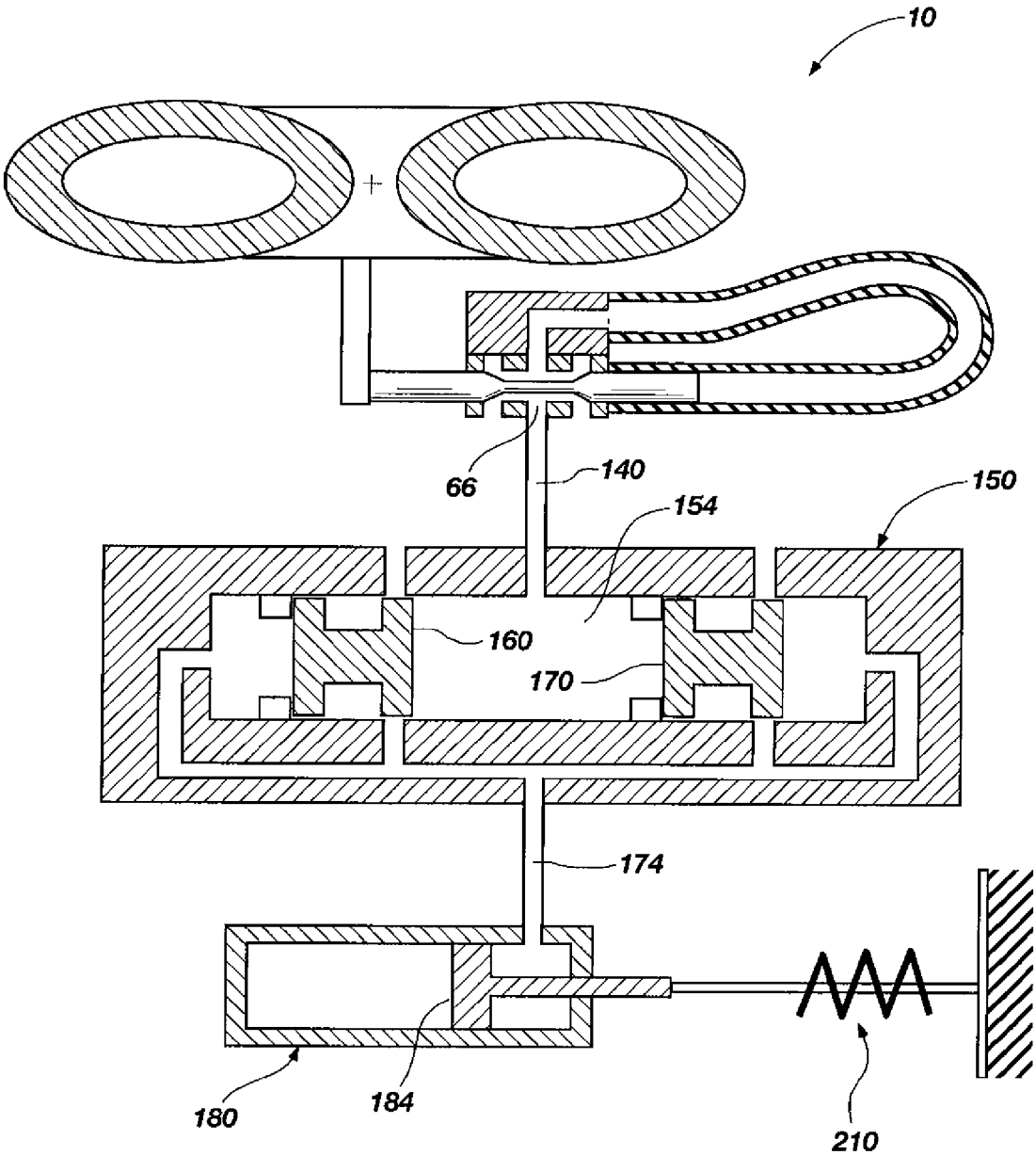
FIG. 7 illustrates a fluid control system incorporating an exemplary pilot valve after the manner of the present invention.

With reference to FIG. 7, illustrated is a fluid control system according to one exemplary embodiment of the present invention, wherein the fluid control system utilizes a first-stage pilot valve in accordance with the invention as taught and claimed herein. As shown, the fluid control system comprises a first-stage pilot valve 10 as discussed above. The pilot valve 10 is in fluid communication with a subsequent or second stage valve component, shown as pressure control valve 150 configured as a dual independent spool pressure control valve, such as those described and claimed in U.S. Pat. Nos. 7,308,848 and 7,284,471 to Jacobsen et al. More specifically, the pilot valve 10 comprises a control pressure port 70 that is in fluid communication with a pilot chamber 154 formed within the pressure control valve 150 via a fluid line 140. The pressure from the control pressure port 70 of the pilot valve 10 operates to set the pilot pressure within the pilot chamber 154 acting on the various spools within the pressure control valve 150, which pilot pressure facilitates control of the spools within the pressure control valve 150.

The pressure control valve 150 may be configured to perform one or more active and/or passive functions, such as driving or actuating a load 210, wherein the pressure control valve 150 comprises dual independent spools 160 and 170 and a resultant intrinsic pressure feedback system. The pressure control valve 150 is designed to regulate the flow of fluid, and more importantly the pressure, within the servo-type system, namely, between the control or pilot pressure and the load 210 or load pressure as induced by an actuator 180 coupled to the load 210, wherein the actuator 180 is configured to convert a received pressure to a force to drive the load 210, and vice versa in response to external forces acting on the load 210. The actuator 180 is in fluid communication with the pressure control valve 150 via the fluid line 174.

One particular example of a fluid control system utilizing the various components described above and shown in FIG. 7 is a robotic system, wherein the pilot valve is configured to supply the input signal or control pressure to a second stage valve component, such as a pressure control valve, which functions to control various actuators that drive corresponding actuator pistons, which drive tendons coupled thereto, which function to turn pulleys to move a limb of the robot. The input signal supplied to the pilot valve will set the pressures in the pressure control valve, and therefore the forces acting on the actuator pistons that drive the tendons to actuate the pulleys.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A pilot valve configured to provide a control pressure to a subsequent valving component within a dynamic fluid system, said pilot valve comprising:

a valve body having a supply port, a return port, and a control pressure port, said control pressure port being in fluid communication with said subsequent valving component;

an axial bore formed in said valve body and in fluid communication with each of said supply, return, and control pressure ports;

a valve spool slidably supported within said axial bore of said valve body, said valve spool adapted to control fluid flow through said supply, return, and control pressure ports, and having symmetrical transition segments to simultaneously vary, for a given range wherein said supply port and said return port are in direct fluid communication with each other, the rate of change of area with respect to displacement of both said supply and return pressure ports upon being displaced, thereby providing a variable resistance to fluid flowing therethrough and reducing the quiescent power of said pilot valve, and wherein said valve spool is positionable to terminate fluid communication between said supply and control pressure ports;

a motor that displaces, in a selective manner, said valve spool within said axial bore about said supply, return, and control pressure ports to apportion fluid therethrough to provide a desired control pressure to said subsequent valving component, wherein said motor urges said valve spool in a direction to open said supply port; and a feedback system having a feedback port in continuous fluid communication with said control pressure port and a feedback passage in continuous fluid communication with said feedback port and said valve spool, said feedback passage configured to receive pressurized fluid therein to act against said valve spool and to urge said valve spool in a direction to close said supply port with a negative feedback force on said motor.

2. The pilot valve of claim 1, wherein said valve spool comprises:

an elongate body having, at least in part, first and second lands configured to fit within said axial bore of said valve body;

a neck formed along at least a portion of a length of said elongate body between said first and second lands, said neck providing a reduced cross-sectional area to facilitate simultaneous fluid flow through said valve body and each of said supply, return, and control pressure ports, wherein said transition segments extend between said first and second lands and said neck, said transition segments configured to vary the rate of change of area of one of said supply and return pressure ports upon said displacement of said valve spool about said supply and return pressure ports and within said axial bore.

3. The pilot valve of claim 1, wherein said transition segments comprise a linearly tapering configuration.

4. The pilot valve of claim 1, wherein said transition segments are selected from the group consisting of a linear configuration, a nonlinear configuration, and a combination of said linear and non linear configurations.

5. The pilot valve of claim 1, a wherein said feedback port is formed in said valve body, and wherein said feedback passage is in continuous fluid communication with an end face of said valve spool, said feedback passage configured to receive pressurized fluid therein to act against said end face of said valve spool and to urge it in a direction to balance the forces acting on said valve spool.

6. The pilot valve of claim 1, wherein said valve body, said valve spool, and said motor are all configured to be operable within a micro environment.

7. The pilot valve of claim 1, wherein said valve spool comprises a circular circumferential configuration with a diameter between 100 and 1,000 microns, fittable within said valve body of a suitable size.

8. The pilot valve of claim 1, wherein said valve spool comprises a circular cross-section.

9. The pilot valve of claim 1, wherein said motor comprises:

a torque motor having a rotor supported about a support structure, said rotor configured to pivot a rocker about a pivot point; and a strut extending from said rocker and configured to engage a first end of said valve spool, said strut functioning to displace said valve spool within said axial bore upon actuation of said torque motor.

10. A pilot valve comprising:

a valve body having a supply port, a return port, and a control pressure port, said pressure control port in fluid communication with a subsequent valving component;

an axial bore formed in said valve body and in fluid communication with each of said supply, return, and control pressure ports;

a valve spool slidably supported within said axial bore of said valve body and comprising symmetrical first and second transition segments extending between first and second lands, respectively, and a neck, said valve spool configured to control fluid flow through said supply, return, and control pressure ports, and to simultaneously vary, for a given range wherein said supply port and said return port are in direct fluid communication with each other, the rate of change of area with respect to displacement of both said supply and return pressure ports upon said first and second transition segments being drawn thereabout, respectively, said transition segments functioning to provide variable resistance to fluid flowing through said supply and return ports and to reduce the quiescent power of said pilot valve, and wherein said valve spool is positionable to terminate fluid communication between said supply and control pressure ports;

a motor having a strut configured to selectively displace said valve spool upon actuation of said motor, wherein said motor urges said valve spool in a direction to open said supply port; and a feedback system having a feedback port in continuous fluid communication with said control pressure port and a feedback passage in continuous fluid communication with said feedback port and said valve spool, said feedback passage configured to receive pressurized fluid therein to act against said valve spool and to urge said valve spool in a direction to close said supply port with a negative feedback force on said motor.

11. A dynamic fluid system comprising:

a first stage pilot valve configured to function as a first stage valve to provide a control pressure, said pilot valve comprising:

a valve spool slidably supported within an axial bore of a valve body, said valve spool adapted to regulate fluid flow through a supply port, a return port, and a control pressure port, and having symmetrical transition segments to simultaneously vary, for a given range wherein said supply port and said return port are in direct fluid communication with each other, the rate of change of area with respect to displacement of both said supply and return pressure ports upon said valve spool being displaced, thereby providing a variable resistance to fluid flowing therethrough and reducing the quiescent power of said pilot valve, and wherein said valve spool is positionable to terminate fluid communication between said supply and control pressure ports;

a motor that displaces said valve spool within said axial bore about said supply, return, and control pressure ports to apportion fluid therethrough to provide a desired control pressure, wherein said motor urges said valve spool in a direction to open said supply port; and a feedback system having a feedback port in continuous fluid communication with said control pressure port and a feedback passage in continuous fluid communication with said feedback port and said valve spool, said feedback passage configured to receive pressurized fluid therein to act against said valve spool and to urge said valve spool in a direction to close said supply port with a negative feedback force on said motor; and a second stage valve component in fluid communication with said control pressure port to receive said control pressure, said second stage valve component functioning to regulate fluid flow and pressure within said dynamic fluid system.

12. The system of claim 11, further comprising an actuator in fluid communication with and operable with said second stage valve component to displace a load.

13. The system of claim 11, further comprising an additional second stage valve component controlled by and operable with said first stage pilot valve.

14. A method for providing a control pressure within a dynamic fluid system, said method comprising:

providing a pilot valve configured to operate within said dynamic fluid system, said pilot valve comprising:

a valve body having an axial bore, a supply port, a return port, and a control pressure port formed therein;

a valve spool disposed within said axial bore, said valve spool having first and second lands, a neck between said first and second lands, and symmetrical transition segments extending between said first and second lands and said neck; and a feedback system having a feedback port in continuous fluid communication with said control pressure port and a feedback passage in continuous fluid communication with said feedback port and said valve spool;

apportioning fluid through said supply, return, and control pressure ports by displacing said pilot valve with a motor that urges said valve spool in a direction to open said supply port to provide a desired control pressure via said control pressure port, wherein said feedback passage receives pressurized fluid therein to act against said valve spool and urges said valve spool in a direction to close said supply port with a negative feedback force on said motor;

simultaneously varying the rate of change of area with respect to displacement of both said supply and return ports with said transition segments upon displacement of said valve spool to provide a variable resistance to fluid flowing therethrough; and selectively positioning said valve spool to terminate fluid communication between said supply and control pressure ports.

15. The method of claim 14, further comprising providing a feedback system configured to act against an end face of said valve spool and to urge it in a direction to balance the forces acting on said valve spool.

16. The method of claim 14, wherein said feedback port is formed in said valve body and wherein said feedback passage is in fluid communication with a portion of said valve spool, said feedback passage configured to receive pressurized fluid therein to act against said valve spool and to urge it in a direction to balance the forces acting on said valve spool from said motor.

17. The method of claim 14, wherein said varying comprises simultaneously drawing said transition segments of said valve spool about both said supply and return ports.

* * * * *